US006688810B2

(12) United States Patent
Jansson

(10) Patent No.: US 6,688,810 B2
(45) Date of Patent: Feb. 10, 2004

(54) REVETMENT USEFUL TO LINE STREAM BED AND ASSEMBLY OF SAID REVETMENTS

(76) Inventor: Jan Erik Jansson, 814 S. Sierra Ave., Solana Beach, CA (US) 92075-2616

( * ) Notice: Subject to any disclaimer, the term of this patent is extended or adjusted under 35 U.S.C. 154(b) by 0 days.

(21) Appl. No.: 10/167,030

(22) Filed: Jun. 11, 2002

(65) Prior Publication Data

US 2003/0228192 A1 Dec. 11, 2003

(51) Int. Cl.[7] ..... F02B 3/12

(52) U.S. Cl. ..... 405/18; 105/16; 105/17; 105/19; 105/20

(58) Field of Search ..... 405/16, 17, 19, 405/20, 302.4, 302.6, 302.7; 404/35, 36, 71, 34, 39, 41, 42; 52/606, 607, 591.4

(56) References Cited

U.S. PATENT DOCUMENTS

| | | | | | |
|---|---|---|---|---|---|
| 140,835 | A | * | 7/1873 | Kilburn | 404/39 |
| 2,008,370 | A | * | 7/1935 | Schwalbe | 52/606 |
| 2,826,906 | A | * | 3/1958 | Rice | 52/606 |
| 3,030,093 | A | * | 4/1962 | Reintjes | 52/606 |
| 5,020,938 | A | * | 6/1991 | Scales | 405/16 |
| 5,108,222 | A | * | 4/1992 | Jansson et al. | 405/20 |

FOREIGN PATENT DOCUMENTS

| | | | | |
|---|---|---|---|---|
| FR | 958086 | * | 3/1950 | 405/16 |
| JP | 61-137911 | * | 6/1986 | 405/302.4 |

* cited by examiner

*Primary Examiner*—Michael Safavi
(74) *Attorney, Agent, or Firm*—Wood, Phillips, Katz, Clark & Mortimer

(57) ABSTRACT

A revetment made wholly or predominantly from concrete, useful to line a stream bed, having upper and lower surfaces, and having upstream and downstream edges, has, for each upstream edge, an upstream bevel, which intersects the upper surface and which intersects said upstream edge. The revetment has an array of holes extending between the upper and lower surfaces. Each hole has a lateral wall flaring outwardly in a downstream direction from a circular mouth at the lower wall to an elongate mouth at the upper wall. Each upstream or downstream edge is stepped so as to define an upper or lower flange. In an assembly of such revetments, which may be connected to one another, as by cables, each of at least some of the upper flanges overlies one of the lower flanges.

10 Claims, 5 Drawing Sheets

REVETMENT USEFUL TO LINE STREAM BED AND ASSEMBLY OF SAID REVETMENTS

TECHNICAL FIELD OF THE INVENTION

This invention pertains to a revetment, which is made wholly or predominantly from concrete and which is useful to line a stream bed, and to an assembly of said revetments. Such a revetment can be also used to line an embankment or to line a driveway for emergency vehicles.

BACKGROUND OF THE INVENTION

As exemplified in older patents including U.S. Pat. No. 2,876,628 and in newer patents including U.S. Pat. No. 5,108,222, U.S. Pat. No. 5,632,571, and U.S. Pat. No. 5,779,391, assemblies of predominantly concrete revetments are employed to line embankments, stream beds, and driveways for emergency vehicles. A reinforced plastic revetment of related interest is disclosed in U.S. Pat. No. 929,728.

As exemplified in U.S. Pat. No. 2,876,628 and in U.S. Pat. No. 5,779,391, cables are employed to connect the respective revetments of such an assembly to one another, whereby the assembly is articulated. As exemplified in U.S. Pat. No. 5,108,222 and in U.S. Pat. No. 5,632,571, a polymeric grid is employed to connect the respective revetments of such an assembly to one another, whereby the assembly is articulated.

As exemplified in older patents including U.S. Pat. No. 1,164,707 and French Patent No. 1,265,140 and in newer patents including U.S Pat. Nos. 3,903,702, 4,661,012, 5,484,230, 5,779,391, 5,906,456, and 6,071,041, it is known for such a revetment to have marginal projections, which interfit with marginal recesses in adjacent, similar revetments. A revetment of related interest is disclosed in U.S. Pat. No. 5,224,792. As disclosed therein, the revetment has projecting spacers that abut or interlock with projecting spacers on an adjacent, similar revetment.

SUMMARY OF THE INVENTION

According to a first aspect of this invention, a revetment is provided, which is made wholly or predominantly from concrete, which is useful to line a stream bed, and which has an upper surface, a lower surface, upstream and downstream edges, and, for each upstream edge, an upstream bevel, which intersects the upper surface and which intersects said upstream edge. Preferably, the revetment has two downstream edges, two upstream edges, and two upstream bevels.

According to a second aspect of this invention, a revetment is provided, as described above, which has an array of holes extending between the upper and lower surfaces. Each hole has a lateral wall having a portion flaring outwardly in a downstream direction from a circular mouth at the lower surface to an elongate mouth at the upper surface.

According to a third aspect of this invention, a revetment is provided, as described above, in which each upstream or downstream edge is stepped so as to define an upper or lower flange.

The first, second, and third aspects of this invention can be advantageously combinedEach of the downstream edges is stepped so as to define an upper flange and each of the upstream edges is stepped so as to define a lower flange Each of the upstream bevels intersects the upper surface and intersects a respective one of the upstream edges. Each hole has a circular mouth at the lower wall and has a lateral wall flaring outwardly in a downstream direction to an elongate mouth at the upper wall.

In an assembly of revetments, which may be connected to one another, as by cables, each of at least some of the upper flanges, if provided, overlies one of the lower flanges, if provided.

Herein, except as the context may require otherwise, any reference to a stream bed is intended to encompass the bed of a natural stream, the bed of another natural waterway, such as a creek, river, or swale, or the bed of a manmade stream, such as a canal, culvert, channel, or ditch, whether the bed tends to be normally dry or tends to be normally filled with flowing water.

Herein, all directional terms including "upper", "lower", "upstream", and "downstream" are referred to a revetment placed in its intended orientation, in a stream bed, or oriented similarly.

DETAILED DESCRIPTION OF THE ILLUSTRATED EMBODIMENTS

Figure 1:
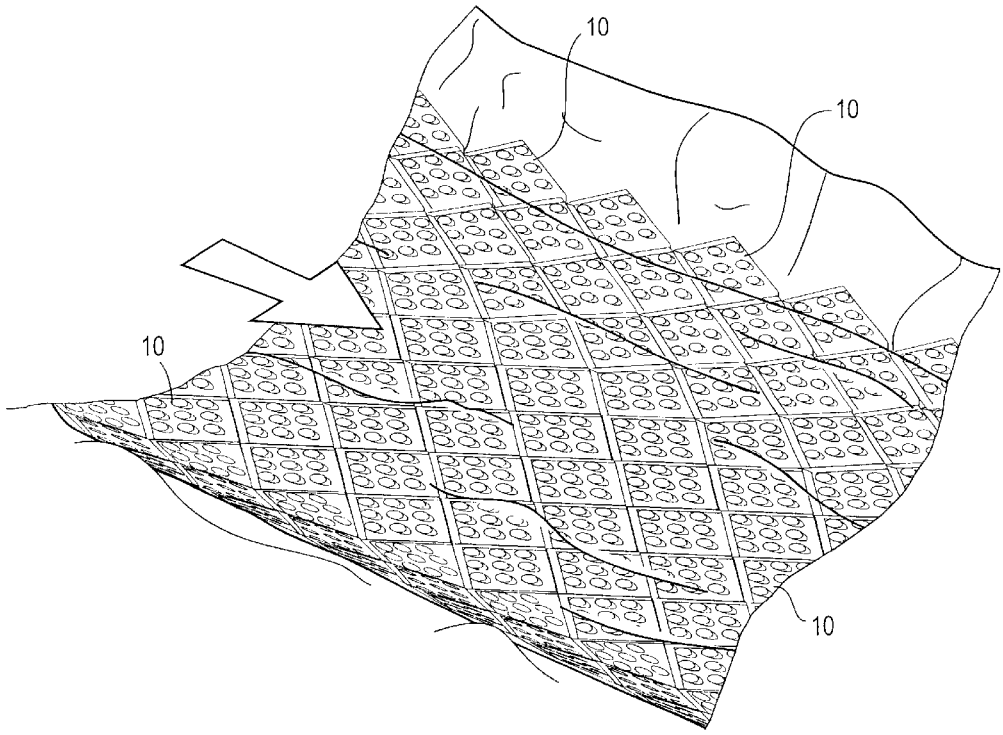
FIG. 1 is a perspective rendition of a stream bed, along which water is flowing in a direction indicated by a large arrow and which is lined by an assembly of revetments, each constituting a preferred embodiment combining the first, second, and third aspects of this invention.

As illustrated in FIG. 1, a stream bed is lined with an assembly of revetments 10, each constituting a preferred embodiment combining the first, second, and third aspects of this invention. The assembly of revetments 10 minimizes erosion of the stream bed and, under potential flooding conditions, helps to confine the stream bed between its normal banks.

As illustrated in FIGS. 2 through 5, each revetment 10 is cast from concrete, which may contain embedded reinforcing bars (rebar) or other embedded reinforcing means, whereupon said revetment 10 is said to be predominantly made from concrete. Whether made wholly or predominantly from concrete, each revetment 10 has an upper surface 20 and a lower surface 30, and when installed in its proper orientation, each revetment 10 has two downstream edges 40 and two upstream edges 50.

Figure 8:
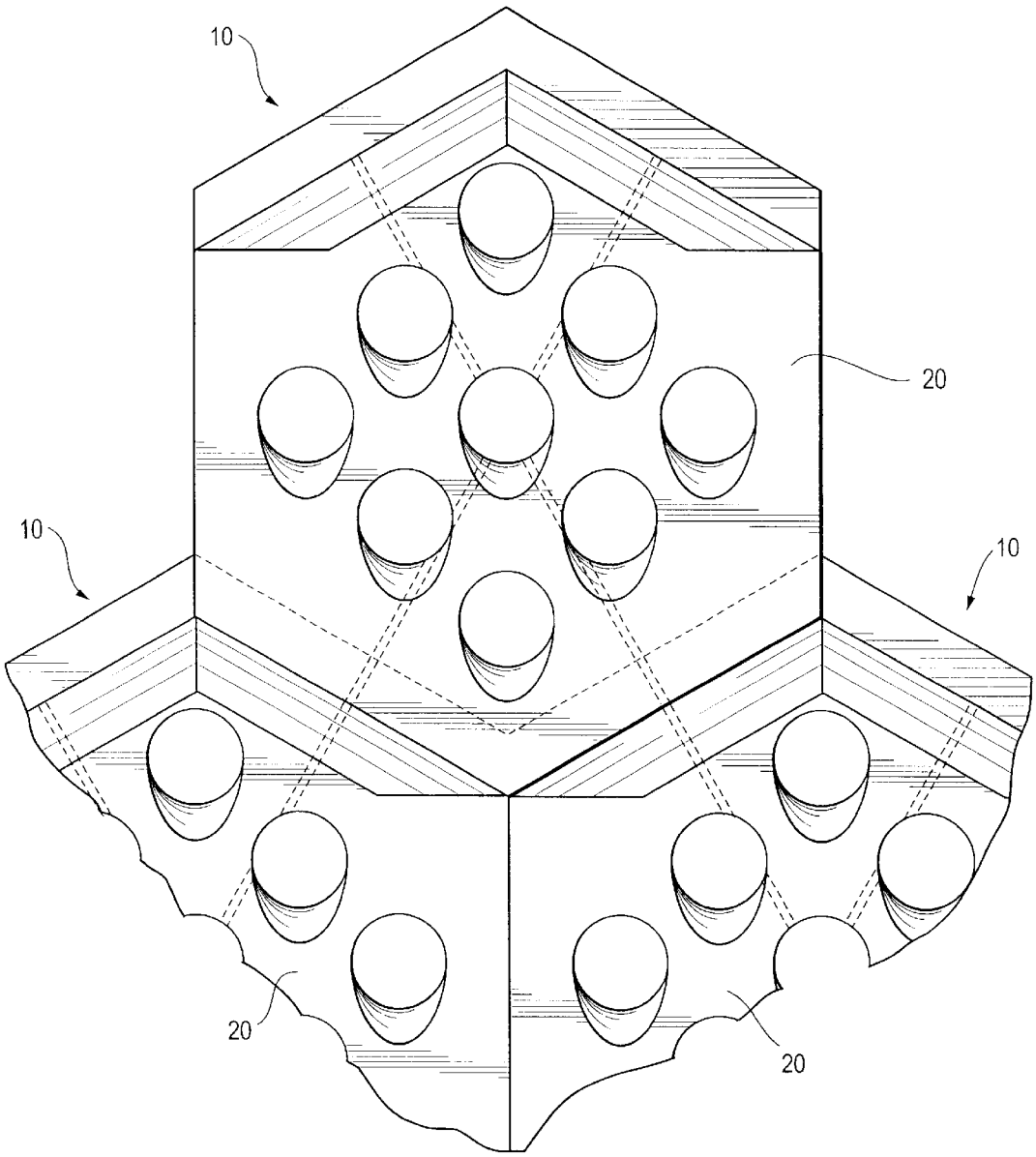
FIG. 8 is a fragmentary, plan view of three revetments of an assembly, each revetment constituting an alternative embodiment of this invention.
Figure 9:
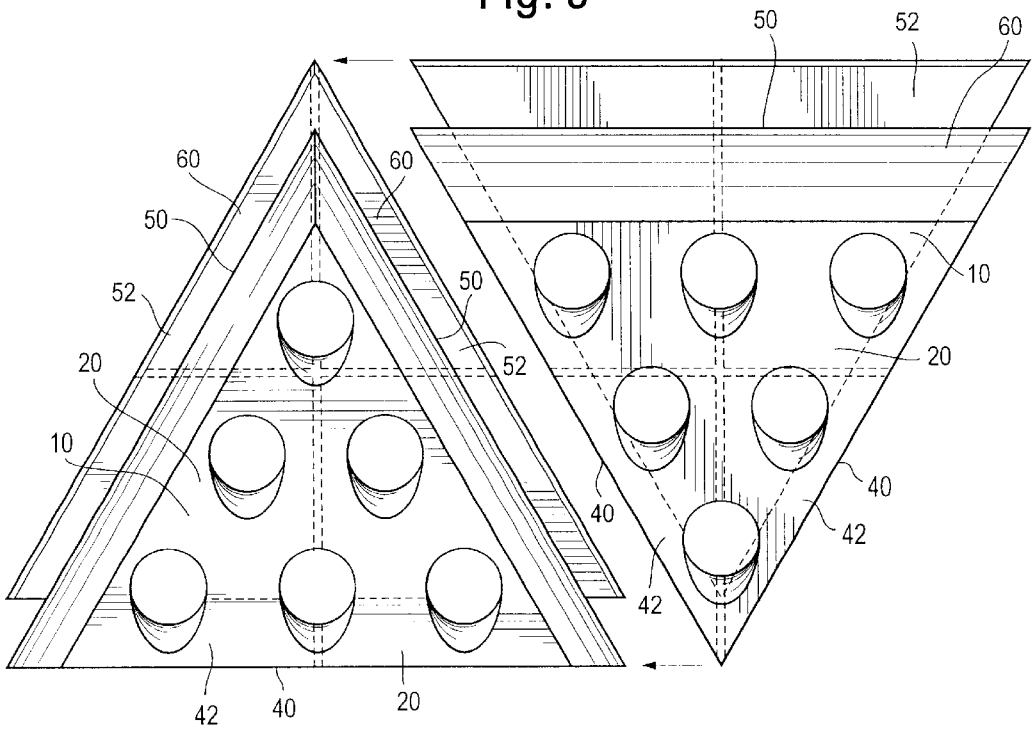
FIG. 9 is a fragmentary, plan view of two revetments of an assembly, each revetment constituting an alternative embodiment of this invention.
Figure 10:
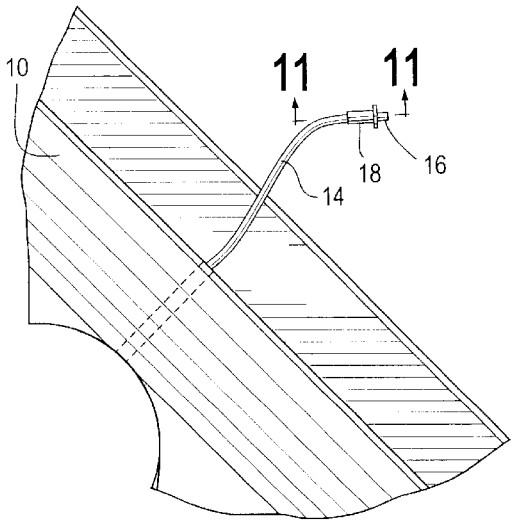
FIG. 10 is an enlarged detail illustrating how a cable used to connect a revetment embodying this invention to a similar revetment, which is not illustrated in FIG. 10, is terminated by a fitment.
Figure 11:
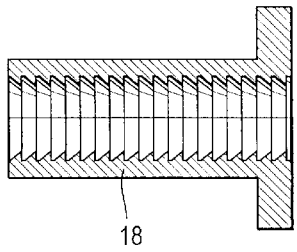
FIG. 11 is am enlarged, cross-section of the fitment, as taken along line 11—11 of FIG. 10, in a direction indicated by arrows.

Preferably, as illustrated in FIGS. 1 through 5, the upper and lower surfaces 20, 30, are square. Alternatively, the upper and lower surfaces are rectangular, but not square. Alternatively, the upper and lower surfaces, are hexagonal and may conform to regular hexagons with apex angles of 45°, as illustrated in FIG. 8. Alternatively, the upper and lower surfaces, are triangular with apex angles of 60° each, as illustrated in FIG. 9, or with two apex angles of 45° and with one apex angle of 90°. Plausibly, the upper and lower surfaces may have be similarly shaped, but not square, rectangular, hexagonal, or triangular.

According to the first aspect of this invention, each revetment 10 has two upstream bevels 60, each of which intersects the upper surface 20 of said revetment 10 and each of which intersects a respective one of the upstream edges 50 of said revetment 10. The upstream bevels 60 direct flowing water, which arrives at said revetment 10, over said revetment 10, rather than against the upstream edges 40 of said revetment 10. If a revetment does not have any upstream bevels, and if flowing water arriving at the revetment were to bear against the upstream edges of the revetment, such water bearing there against could tend to tip the revetment.

Each revetment 10 has an array of similar holes 70 extending between its upper face 20 and its lower face 30 and allowing vegetation to grow upwardly from the stream bed, through the arrayed holes 70, whereby to help to secure said revetment 10 within the stream bed. Heretofore, it has been known for a concrete revetment to have an array of holes, through which vegetation can grow.

According to the second aspect of this invention, each hole 70 of each revetment 10 has a circular mouth 72 at the lower surface 30 of said revetment 10 and a lateral wall 74 flaring outwardly to an elongate, ovoid mouth 76 at the upper surface 20 of said revetment 10. The flaring walls 74 of the holes 70 direct flowing water, which reaches those walls 74, over the revetments 10. If the lateral walls of the holes in a revetment were cylindrical between the upper and lower surfaces of the revetment, and if flowing water arriving at the revetment were to bear against the cylindrical walls, such water bearing against could tend to tip the revetment.

Figure 7:
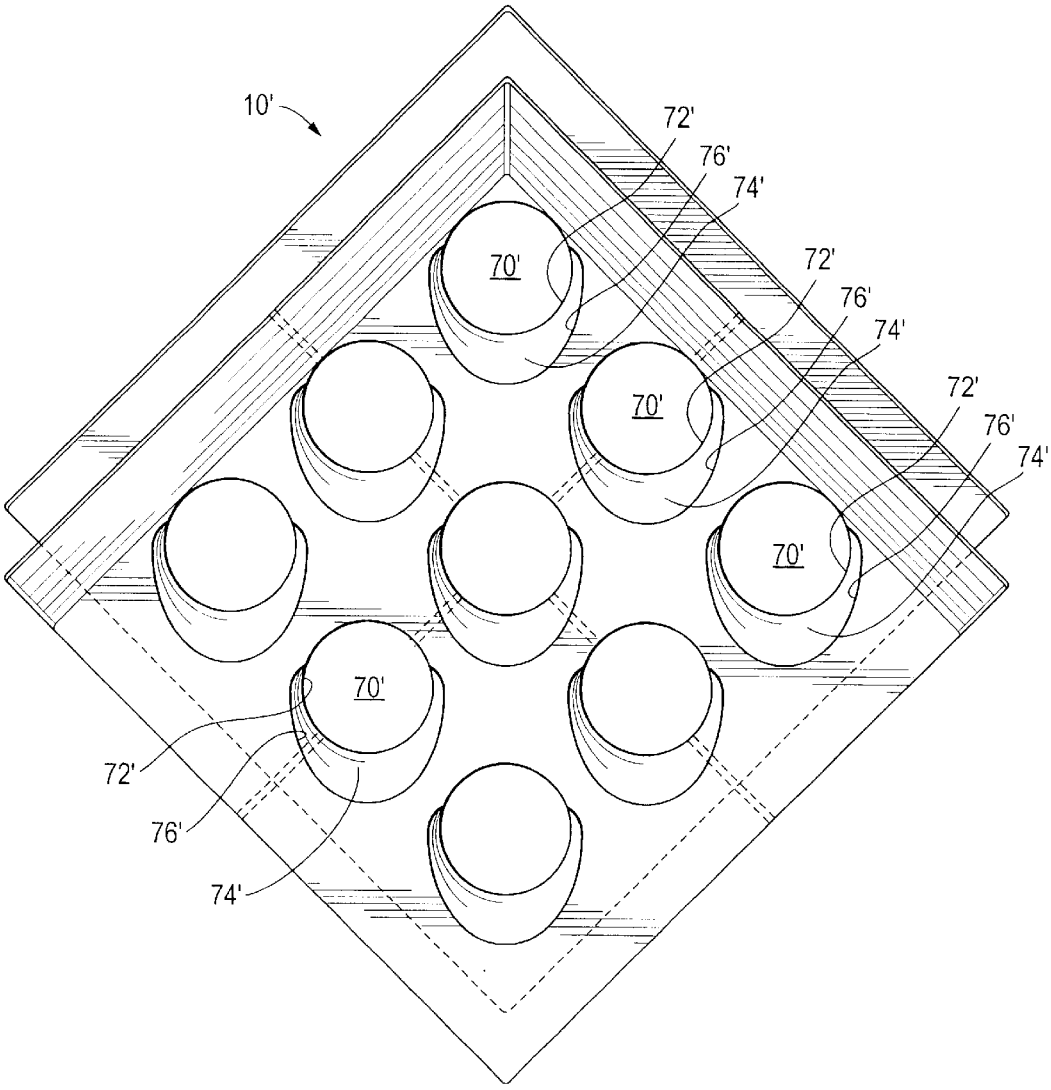
FIG. 7, which is analogous to FIG. 3, is an upper plan of a revetment constituting an alternative embodiment combining the first, second, and third aspects of this invention.

As illustrated in FIG. 7, a revetment 10 according to an alternative embodiment of this invention is similar to the revetments 10, except that each hole 70' has a circular mouth 72', which is similar to the circular mouths 72 of the revetments 10, and has a lateral wall 74' flaring outwardly and crosswise to an elongate, widened mouth 76', which is analogous to the elongate, ovoid mouths 76 of the revetments 10.

Figure 2:
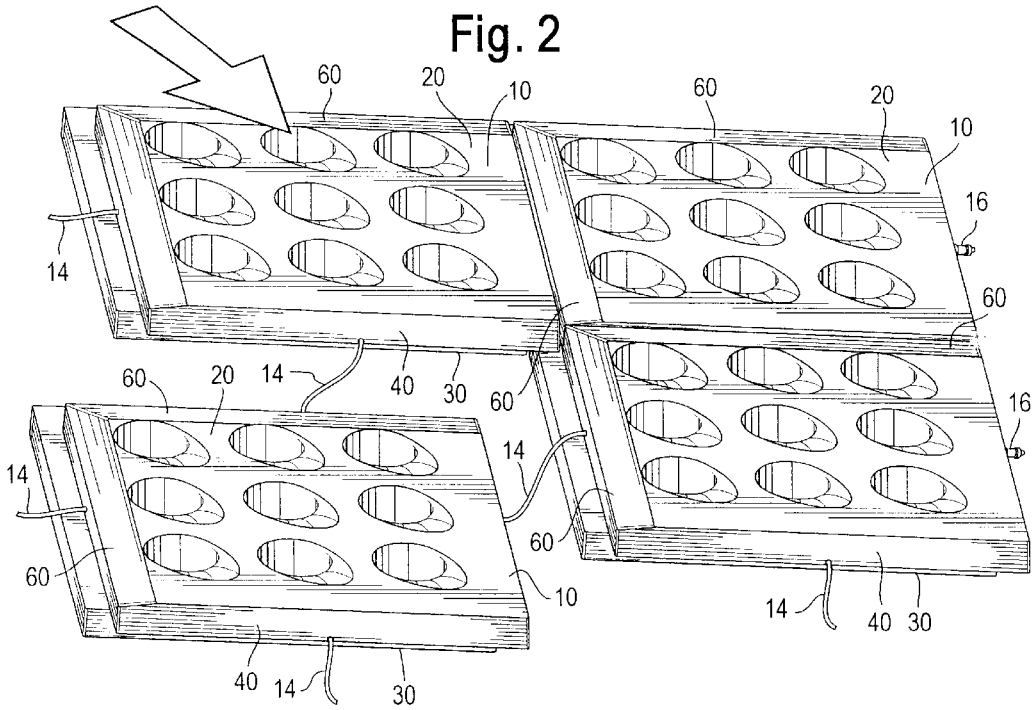
FIG. 2, on an larger scale compared to FIG. 1 is a perspective view of four revetments of such an assembly, one revetment being separated from the other revetments so as to reveal cables used to connect the revetments to one another.
Figure 3:
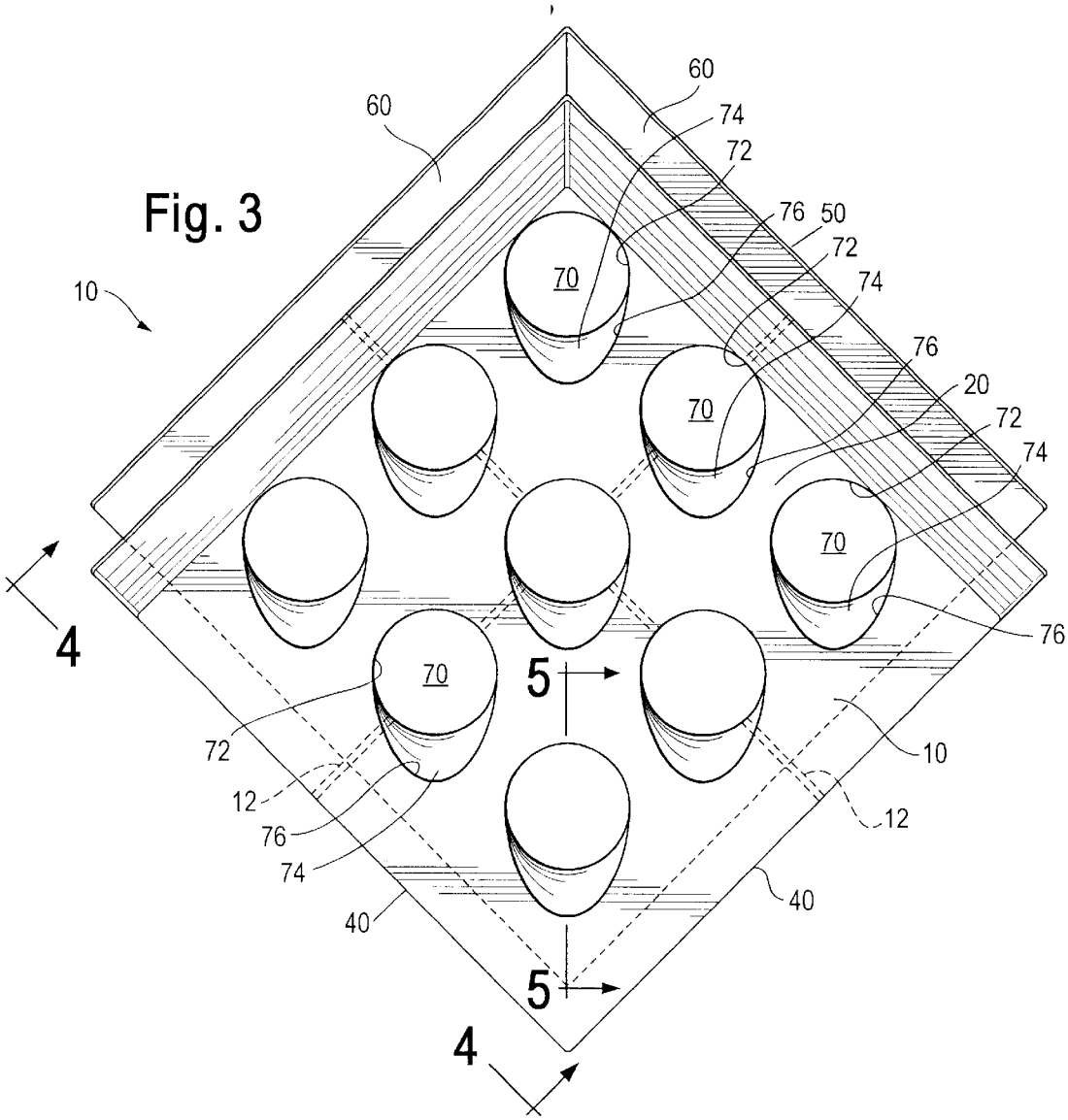
FIG. 3, on a larger scale compared to FIG. 2, is an upper plan of an exemplary one of the revetments.
Figure 4:
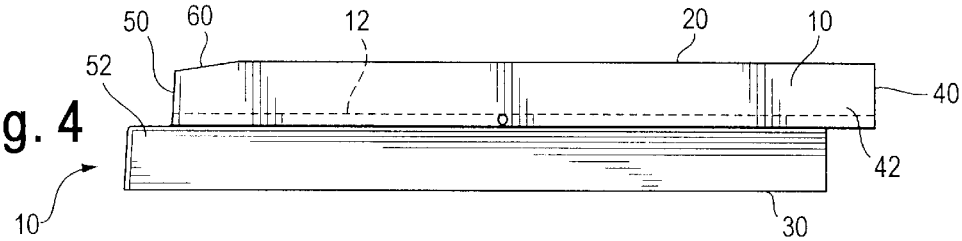
FIG. 4 is an elevation taken along line 4—4 in FIG. 3, in a direction indicated by arrows.
Figure 5:
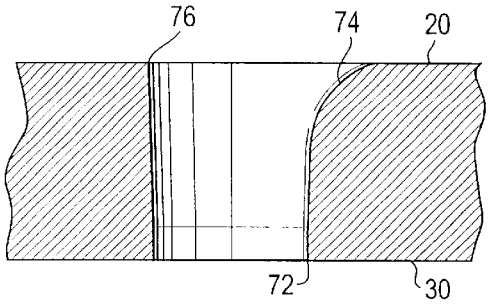
FIG. 5, on a larger scale compared to FIGS. 3 and 4, is a section taken along line 4—4 in FIG. 3, in a direction indicated by arrows.
Figure 6:
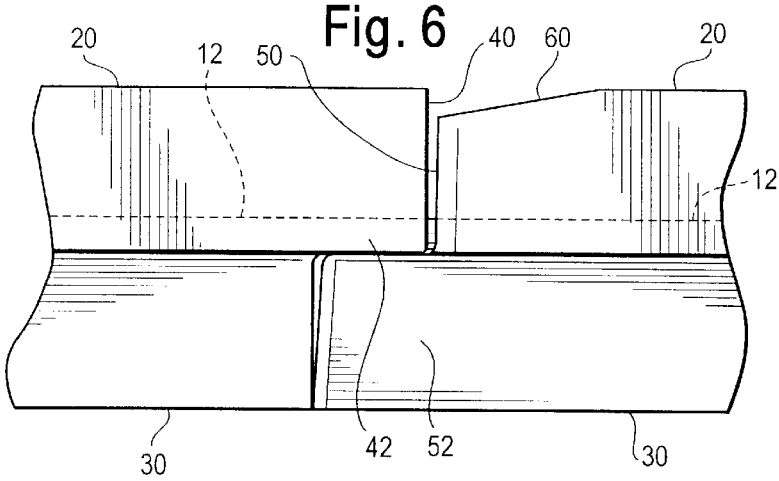
FIG. 6, on a larger scale compared to FIGS. 3 and 4 but a smaller scale compared to FIG. 5, is a fragmentary detail illustrating how a flange on one such revetment engages and overlies a flange on the next revetment, in such an assembly.

According to the third aspect of this invention, each downstream edge 40 of each revetment 10 is stepped so as to define an upper flange 42 and each upstream edge 30 of each revetment 10 is stepped so as to define a lower flange 52. In the assembly, as illustrated in FIG. 2 and in FIG. 6, the lower flanges 52 of each given revetment 10 underlie the upper flanges 42 of the next revetments 10, except for the revetments 10 along the opposite edges of the assembly.

When the upper and lower surfaces are triangular, as illustrated in FIG. 9, the revetments 10 may be made in two complementary configurations. One such configuration, which is exemplified by the left-hand configuration of FIG. 9, may have one downstream edge 40, which is stepped so as to define an upper flange 42, two upstream edges 50, each of which is stepped so as to define a lower flange 52, and two upstream bevels 60. The other configuration, which is exemplified by the right-hand configuration of FIG. 9, has two downstream edges 40, each of which is stepped so as to define an upper flange 42, one upstream edge 50, which is stepped so as to define a lower flange, and one upstream bevel 60.

Each revetment 10 is provided with longitudinal and transverse passages 12 to receive cables 14, which are used in some but not all installations to connect the revetments 10 to one another in the assembly, in a known manner. At their opposite ends 16, the cables 14 carry speed nuts or other suitable fitments 18, which have portions that are larger than the passages 12 so as to prevent the cables 14 from being pulled inadvertently through the passages 12. The cables 14 also help to prevent tipping of the revetments 10. The cables 14 may be thus used in comparatively shorter lengths to connect two revetments 10 to each other in a pair and in comparatively longer lengths to connect a larger number of revetments 10 to one another in a series. Although polymeric cables are preferred, e.g., polyester cables, metal cables may be alternatively used. Although cables having circular cross-sections are preferred, cables of other cross-sections, such as flat straps, may be alternatively used.

Although designed primarily to line stream beds, in which flowing water tends to cause erosion, revetments embodying this invention can be also used to line embankments or to lie driveways for emergency vehicles and may have other practical uses.

What is claimed is:

1. An assembly of revetments made wholly or predominantly from concrete, useful to line a stream bed, comprising:

at least two revetments, each including a substantially rectangular body having upper and lower surfaces the upper surface having an upstream edge along one side of the substantially rectangular body and a downstream edge along an opposite side of the substantially rectangular body, and a bevel in the upper surface along substantially the entirety of the upstream edge the bevel presenting a shorter body along the upstream edge than the body along the downstream edge; and an array of holes extending between the upper and lower surfaces, said holes intersecting said substantially smooth upper surface and at their upper ends flaring outwardly in a downstream direction;

the revetments being assembled with the downstream edge of one said revetment positioned adjacent the upstream edge of the other revetment and with the downstream edge of said one revetment disposed above the upstream edge of the other revetment.

2. An assembly of revetments made wholly or predominantly from concrete, wherein said assembly includes a plurality of said revetments lining stream bed a and comprising:

at least two revetments, each including a substantially rectangular body having upper and lower surfaces, the upper surface having an upstream edge along one side of the substantially rectangular body and a downstream edge along an opposite side of the substantially rectangular body, and a bevel in the upper surface along substantially the entirety of the upstream edge, the bevel presenting a shorter body along the upstream edge than the body along the downstream edge;

the revetments being assembled with the downstream edge of one said revetment positioned adjacent the upstream edge of the other revetment and with the downstream edge of said one revetment disposed above the upstream edge of the other revetment.

3. The assembly of claim 2, wherein said revetments are stepped along said one side of said substantially rectangular body so as to define a lower projecting flange along the width of said one side of said substantially rectangular body and stepped along the other side of said substantially rectangular body so as to define a recess thereunder along said opposite side of said substantially rectangular body, said revetments being assembled with said lower projecting flange received in said recess of an adjacent revetment.

4. A revetment made wholly or predominantly from concrete, useful to line a stream bed, having:

an upper surface, said upper surface being substantially smooth;

a lower surface;

two downstream edges, each of which is stepped so as to define an upper flange;

two upstream edges, each of which is stepped so as to define a lower flange; and an array of holes extending between the upper and lower surfaces, said holes intersecting said substantially smooth upper surface and at their upper ends flaring outwardly in a downstream direction.

5. An assembly of revetments according to claim 4, wherein at least one of the upper flanges overlies one of the lower flanges.

6. The assembly of claim 5, wherein the revetments are connected to one another.

7. A revetment made wholly or predominantly from concrete, useful to line a stream bed, having:

having upper and lower surfaces, having upstream and downstream edges, each of which is stepped to define an upper or lower flange, said upper surface being substantially smooth; and an array of holes extending between the upper and lower surfaces, said holes intersecting said substantially smooth upper surface and at their upper ends flaring outwardly in a downstream direction.

8. An assembly of revetments according to claim 7, wherein certain of said upstream and downstream edges are stepped so as to define upper flanges and others of said upstream and downstream edges are stepped so as to define lower flanges and wherein at least one of the upper flanges overlies one of the lower flanges.

9. The assembly of claim 8, wherein the revetments are connected to one another.

10. An assembly of revetments according to claim 7 or claim 4, wherein the revetments are connected to one another.

* * * * *